US009826804B1

(12) United States Patent
Percival

(10) Patent No.: US 9,826,804 B1
(45) Date of Patent: Nov. 28, 2017

(54) CIRCULAR JEWELRY CAGE WITH CHANGEABLE RAISED INSERT

(71) Applicant: Nolan Percival, New York, NY (US)

(72) Inventor: Nolan Percival, New York, NY (US)

( * ) Notice: Subject to any disclaimer, the term of this patent is extended or adjusted under 35 U.S.C. 154(b) by 353 days.

(21) Appl. No.: 14/595,841

(22) Filed: Jan. 13, 2015

(51) Int. Cl.
*A44C 15/00* (2006.01)
*A44C 25/00* (2006.01)

(52) U.S. Cl.
CPC ..... *A44C 25/002* (2013.01); *A44C 25/007* (2013.01)

(58) Field of Classification Search
CPC ... A44C 25/004; A44C 25/002; A44C 25/007; A44C 25/00
USPC ..... 63/1.14, 1.15, 18, 19, 40, 23, 29.1, 29.2, 63/30
See application file for complete search history.

(56) References Cited

U.S. PATENT DOCUMENTS 394,928 A * 12/1888 Kutner ..... A44C 17/0208 63/29.1
2,300,342 A 6/1941 Cheney
4,343,104 A 8/1982 Szabo
4,534,185 A 8/1985 Berry et al.
5,687,494 A 11/1997 Laurent
7,437,840 B2 10/2008 Ratmansky et al.
7,441,359 B2 10/2008 Wang
7,967,464 B2 6/2011 Ratmansky et al.
8,240,868 B1 8/2012 Slims
2007/0209247 A1* 9/2007 Raisner ..... A44B 15/005 40/323
2015/0320156 A1* 11/2015 Meisenbach ..... A44C 25/002 63/1.14

OTHER PUBLICATIONS chrysdesignsjewelty, http://www.etsy.com/listing. Accessed on Oct. 31, 2014.

* cited by examiner

*Primary Examiner* — Jack W Lavinder
(74) *Attorney, Agent, or Firm* — Michael J. Feigin, Esq.; Feigin and Fridman

(57) ABSTRACT

A jewelry cage holds one of multiple circular discs. These circular discs are interchangeable and can have raised indicia above a circular portion of the disc, which are viewable through a portal of the cage. The cage itself can be two parts, hinged together and sized to hold the disc there-in when the cage is closed.

11 Claims, 8 Drawing Sheets

CIRCULAR JEWELRY CAGE WITH CHANGEABLE RAISED INSERT

FIELD OF THE DISCLOSED TECHNOLOGY

The disclosed technology relates generally to jewelry, and, more specifically, to jewelry with removable parts.

BACKGROUND OF THE DISCLOSED TECHNOLOGY

Jewelry and other adornments come\ in many sizes and shapes. More specifically, lockets are a type of jewelry generally having a hinge between two sides, which allows one to open the locket and look inside. The external look of the locket or other jewelry item remains the same. While it is possible to have a translucent exterior allowing one to see the inside of the jewelry item, this is not always desired because it may decrease the overall appeal, beauty, and worth of the item.

Therefore, if an individual wants to change the look of the jewelry, he/she would probably wear a different item of jewelry altogether. This, of course, adds expense. Imagine the owner of a diamond-studded pendant who wants to display a sapphire in its center instead of an amethyst, t in order to match an outfit. To do so, one needs to have an entire second set of diamonds on another piece of jewelry, the body of the jewelry item generally being constructed of a precious metal.

What is needed is a way to change the look of a jewelry item without having to change the jewelry in its entirety. This would allow the wearer to customize his/her jewelry at a significantly decreased cost.

SUMMARY OF THE DISCLOSED TECHNOLOGY

The disclosed technology relates to a jewelry cage with a removable disc. In embodiments of the disclosed technology, the jewelry cage is formed from an identical (defined as "within an acceptable tolerance level in the art of jewelry to be considered as such") circular upper portion and lower portion. A first part of a closure is attached to the circular upper portion, and a second part of the closure is attached to the circular lower portion. The circular upper portion further has a circular portal, a portion thereof having a first, larger circumference and another portion thereof having a second, smaller circumference. The circular lower portion has a circular portal, a portion thereof having a first larger circumference equal (see definition of "identical" which also applies to words like "equal" and other language which is synonymous with "exact") to that of the first larger circumference of the circular portal of the circular upper portion. A portion thereof further has a second smaller circumference equal to that of the second smaller circumference of the circular portal of the circular upper portion.

In the above embodiment, a hinge can pivotally attach the circular upper portion to the circular lower portion, such that the circular upper portal and the circular lower portal can pivot about the hinge away from and towards each other. When the circular upper portal and the circular lower portal are pivoted fully towards each other, a continuous portal extending between both the circular upper portal and the circular lower portal are formed, and the circular upper portion and the circular lower portion are aligned at exterior and interior sides of each respective circle of the circular lower portal and the circular upper portal.

Still referring to the above-described embodiments, a circular disc having a round portion and a raised portion permanently attached can be used there-with. The round portion has a circumference equal to that of the larger circumference of the upper portion, as well as the larger circumference of the lower portion. The circumference of the round portion is greater than the circumference of the smaller circumference of the upper portion and the smaller circumference of the lower portion. Further, a raised portion can have a greatest distance, in a direction parallel to the round portion, less than that of a diameter of the smaller circumference of the upper portion.

In some embodiments, the cage has a circular upper portion, a circular lower portion, and a circular portal having three circular sections. These sections include a first circular section defined by the circular upper portion, a third circular section defined by the circular lower portion, and a second circular section defined at least by the circular lower portion, and having a diameter greater than that of the first and third circular sections. A disc having a greatest diameter which is greater than that of the first and third circular sections, and less than that of said second circular section, is also included. The disc is interchangeable with other discs sharing these characteristics.

The first circular section and the third circular section are identical, in embodiments of the disclosed technology. The third circular section has, in embodiments, a solid base forming a bottom of the circular lower portion which the disc contacts or rests thereon (the disc is) positioned between the circular upper portion and the circular lower portion. The second circular section is differentiated from the first circular section by a circumferential lip extending inward at the first circular section, such that the second circular section has a diameter greater than that of the first section.

A hinge with a single arc direction (circular or parabolic) of movement rotates the circular upper portion and the circular lower portion between two configurations. In a first configuration, the circular upper portion and the circular lower portion are aligned with each other, forming a new circular shape having a diameter equal to that of each circular portion and a depth equal to that of the first and second portions combined. In a second configuration, the circular upper portion and the circular lower portion are at a right or obtuse angle with respect to one another.

The disc has raised indicia passing into the first circular section of the circular upper portal, in embodiments of the disclosed technology. The raised indicia can form a unitary structure with a circular portion of the disc having a greatest diameter which is greater than that of the first and third circular sections. The raised indicia extend from the circular portion of the disc into and/or (inclusive of all combinations of the terms) past the first circular section, in embodiments.

A jewelry cage of embodiments of the disclosed technology can also be described as having a hinged top and bottom section, with a connector holding the top and bottom sections together, a circular portal, extending through the top and bottom sections, having a greater circumference in a mid-region, where the top and bottom sections meet, than at an extremity of each of the top and the bottom sections which are furthest away from the other described bottom and top sections. A disc with a circumference less than, or equal to, the greater circumference of the mid-region, and greater than, or equal to, an entirety of the circular portal is also used therewith in embodiments. The disc is removably situated in the circular portal and has indicia viewable within the circular portal. The disc is fixed in position with respect to the hinged (and closed) top and bottom section, in embodiments. The disc is removable by separating the top and bottom sections from each other. This disc can fill an entirety of the mid-region of the circular portal, at least a part of the top section of the circular portal, and/or extend past the circular portal.

DETAILED DESCRIPTION OF EMBODIMENTS OF THE DISCLOSED TECHNOLOGY

In an embodiment of the disclosed technology, a jewelry cage holds one of multiple circular discs. These circular discs are interchangeable and can have raised indicia above a circular portion of the disc which are viewable through a portal of the cage. The cage itself can have or consist of two parts, hinged together and sized to hold the disc there-in when the cage is closed.

Embodiments of the disclosed technology will become clearer in view of the following discussion of the figures.

Figure 13:
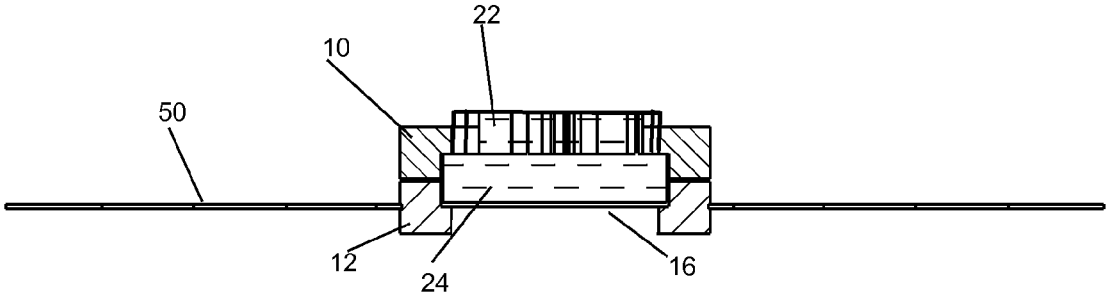
FIG. 13 shows a cross section through a closed cage of the embodiments of the disclosed technology.
Figure 14:
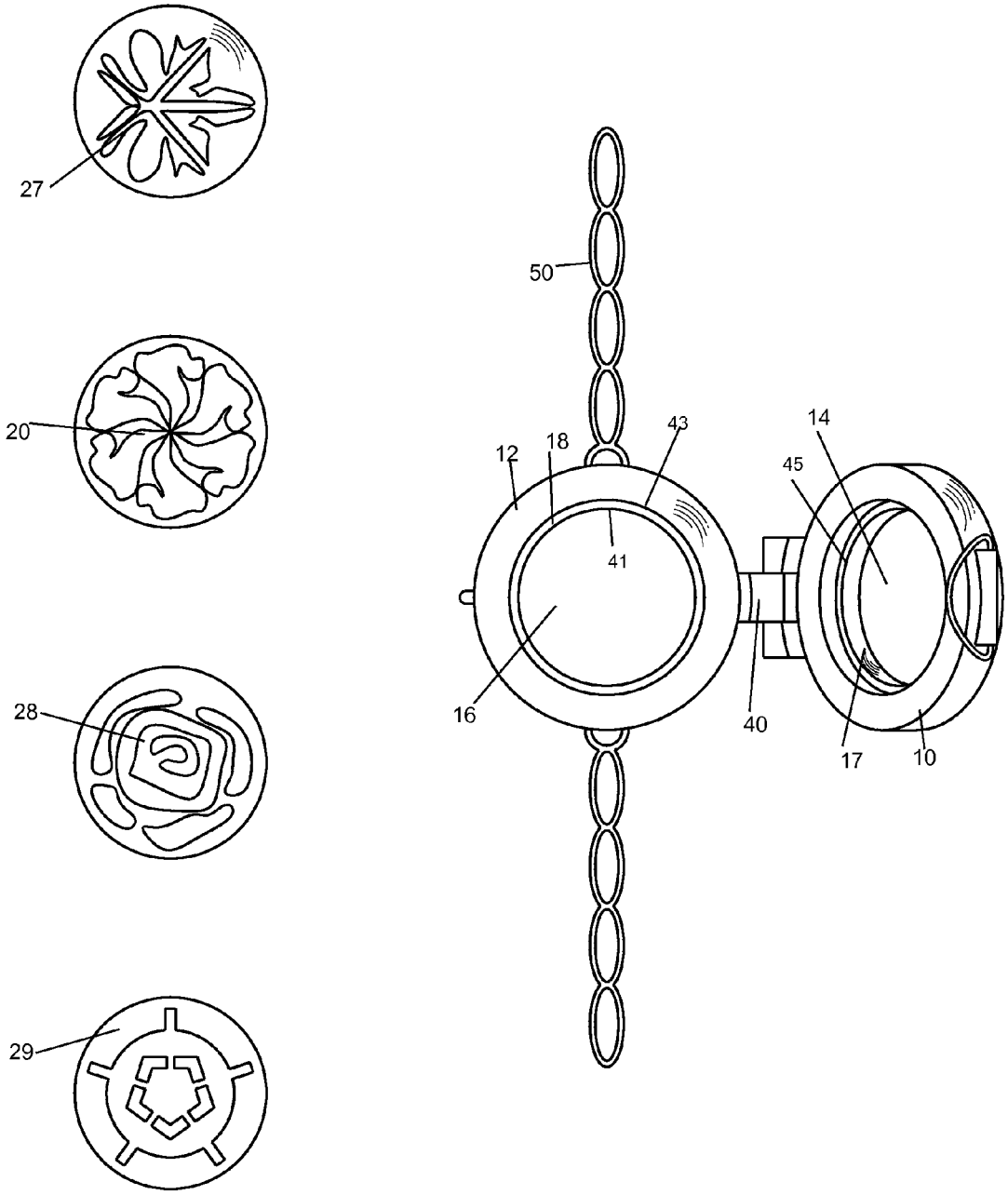
FIG. 14 shows a top perspective view of the cage with interchangeable discs.

Skipping first to FIG. 14, this figure shows a top perspective view of the cage with interchangeable discs. The discs 20, 27, 28, and 29 have a circular base (24, see FIG. 13) of a greater width than the pattern on top (22, see FIG. 13). The pattern on the top portion of the disc is raised from the circular base, in embodiments of the disclosed technology, such that when inserted into circular portal 16 of a bottom section 12 of the cage, the disc sits within the base of the cage 12, while the pattern and/or (inclusive) design on the disc, in its entirety shows through the portal 14 of the upper section 10 of the cage. Each of the lower section 12 and upper section 10 of the cage, in embodiments of the disclosed technology, has a narrower portion (18 and 17, respectively) and a wider portion.

The wider portion is on the "inside," where the upper side 10 and lower side 12 portions of the cage join when rotated together around the hinge 40. That is, the "inside" is defined as having a circular interior section with the same diameter (within an acceptable tolerance level known in the art) which is directly adjacent to, and joins with, an additional circular interior section of this same diameter of the other side of the cage. The "outside" sections of the upper and lower cage have a portal with a wider diameter than that of the "inside" sections. In FIG. 14, these sections are numbered 18 (on the lower portion) and 17 (on the upper portion). Still discussing FIG. 14, a chain 50 can be attached to the cage, such that the charm can be worn as part of a necklace or bracelet.

Moving backward now to FIG. 13, this figure shows a cross section through a closed cage of the embodiments of the disclosed technology. Here, the circular disc 29 of FIG. 14 is shown with its component parts, 22 and 24. The circular region 24 has a diameter greater than that of the portal 16 in the lower portion 12 of the cage, as well as the portal 14 (see, for example, FIG. 9) of the upper portion 10 of the cage. In this example, the upper portion of the circular disc, the raised portion 22, forms a unitary structure with the circular disc 29 (and/or, inclusive, is fixedly attached thereto). The raised portion of the disc 22 extends through the portal 22 and, in embodiments, above a horizontal line defined by the uppermost extremity of the upper portion 10 of the cage. The "uppermost extremity" is further defined as farthest away from the bottom portion of the cage when the cage is in a closed condition, such that the upper and lower portions abut at an entire circle.

Therefore, when the cage is closed, with the top and bottom portions held together, the disc 20 is held in place between the top 10 and bottom 12 by way of ridges 45 and 43 of both the top 10 and bottom 12 portions of the cage (FIGS. 9, 13) which are circular and have a diameter smaller than that of the widest portion of the disc 20 and/or (inclusive) wider section 24 of the disc 20. Further, the upper portion of the disc, with a raised three-dimensional design (in embodiments), has a greatest diameter smaller than or equal to (inclusive of both terms) the narrowest diameter of the upper portion 10 of the cage. As such, the raised portion 22 can fit snugly in the opening formed in the top portion of the cage and a tight seal can be formed around the disc 20.

Figure 11:
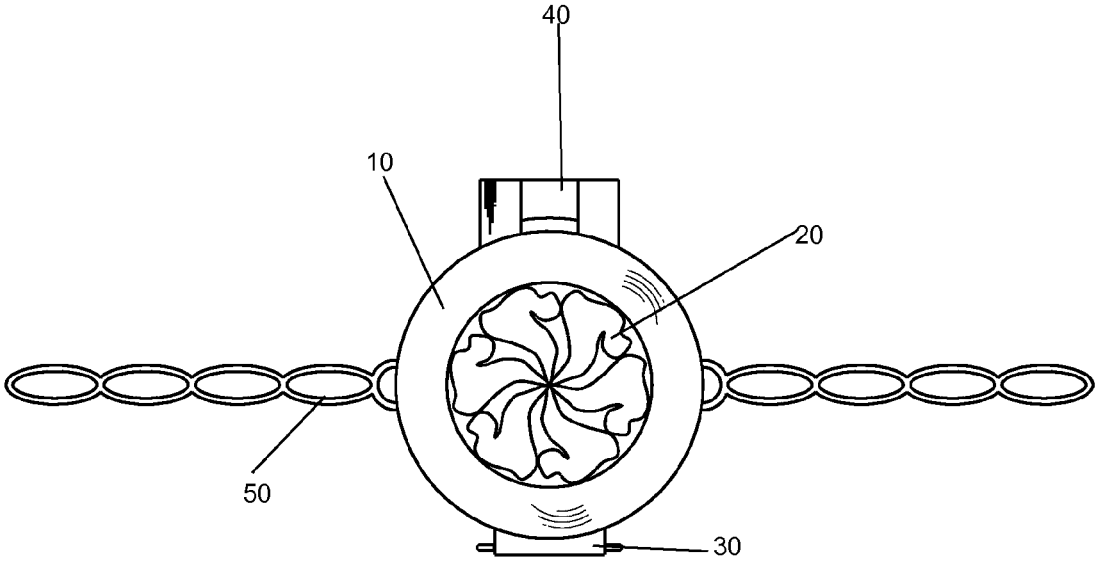
FIG. 11 shows a top plan view of a jewelry cage with disc situated there-in, in embodiments of the disclosed technology.
Figure 12:
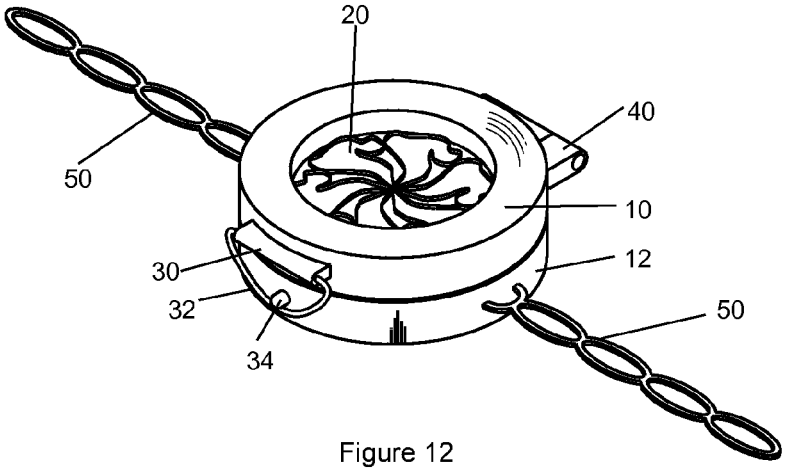
FIG. 12 shows a top and side perspective view of a jewelry cage with disc situated there-in of embodiments of the disclosed technology.

Moving backward through the drawings, FIG. 12 shows a top and side perspective view of a jewelry cage with disc situated there-in, of embodiments of the disclosed technology. FIG. 11 shows a top plan view of a jewelry cage with disc situated there-in, in embodiments of the disclosed technology. Here, the disc 20 is a three-dimensional design rising above the wider interior portal formed from the upper 10 and lower 12 portions of the cage. The cage is held together, in a closed condition, by a hinge 40 and closure 30, 32, and 34. It should be understood that any mechanism for hinging and/or (inclusive) for reversibly holding together the top and bottom portions of the cage can be used. The disc is held in place in the cage and, in embodiments, cannot move or shift relative to either of the upper 10 or lower 12 portions of the cage. "Reversibly," for purposes of this disclosure, is defined as "being able to repeatedly open and close the cage by hand without the aid of tools, or damage to or destruction of the cage." By contrast, for purposes of this disclosure, a "permanent" attachment is one which requires specialized tools and causes damage to, or leaves residue on, a piece which has broken apart. It should be understood that, in alternative embodiments, any of the individually labeled parts of the elements of the figures or elements which are described in the specification can be, or are, reversible or permanently attached.

Figure 9:
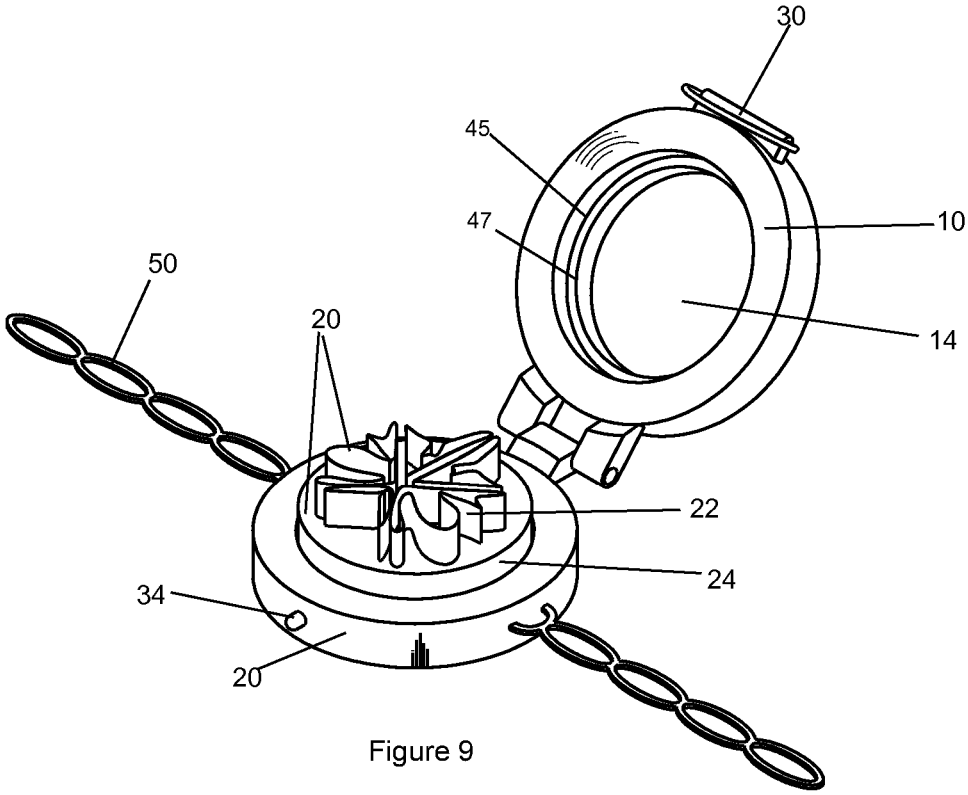
FIG. 9 shows a top perspective view of the jewelry cage with disc in an open condition, of an embodiment of the disclosed technology.
Figure 10:
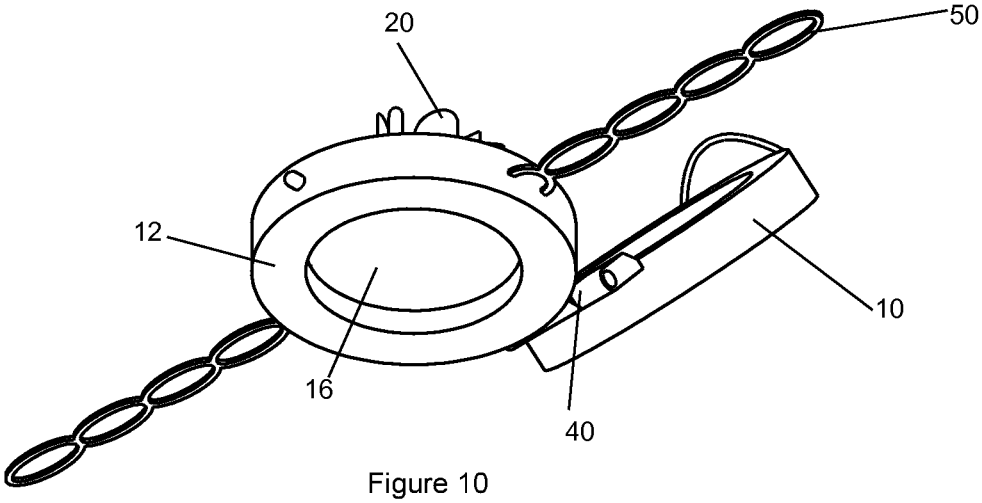
FIG. 10 shows a bottom perspective view of the jewelry cage with disc in an open condition, of an embodiment of the disclosed technology.

FIG. 9 shows a top perspective view of the jewelry cage with disc in an open condition or position, of an embodiment of the disclosed technology. FIG. 10 shows a bottom perspective view of the jewelry cages with disc in an open position, of an embodiment of the disclosed technology. Discussing the two figures simultaneously, one can see into the respective portals 14 and 16 of the top 10 and bottom 12 portions of the cage. The disc 20 has a lower circular section 24 with a diameter substantially equal to (defined as within an acceptable tolerance level or at least 95% thereof) the smallest diameter of both portals of the upper 10 and lower 12 portions of the cage. In an embodiment, the circular region (including circular portal) of the upper 10 and lower 12 portions of the cage are identical and arranged in mirror images with respect to one another. When the disc 22 (or any other disc) is situated in the portals, half the disc 22 is between and/or within the upper portion 10 of the cage, and the other half of disc 22 is between and/or within the lower portion 20 of the cage.

Figure 7:
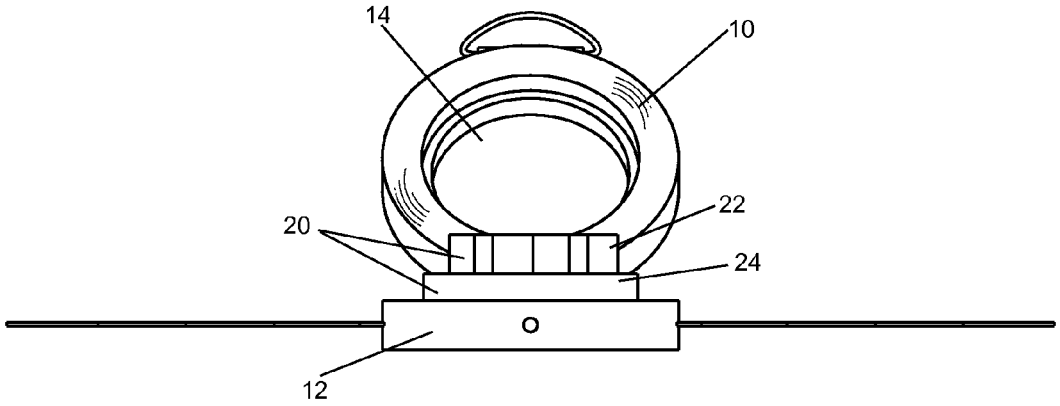
FIG. 7 shows a front elevation view of the jewelry cage with disc of an embodiment of the disclosed technology.
Figure 8:
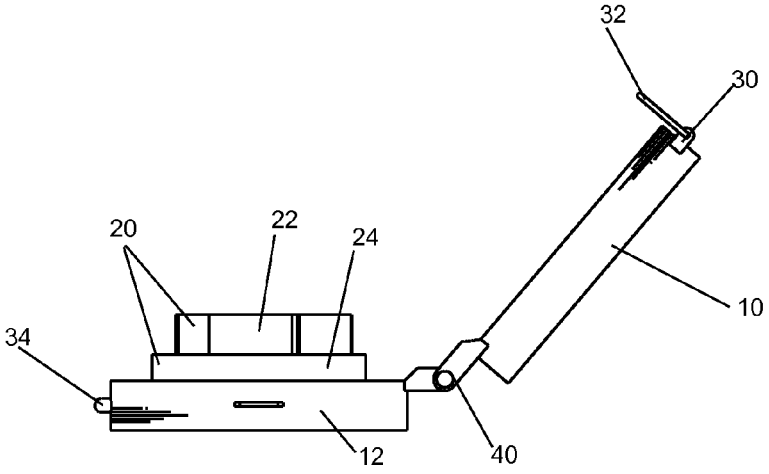
FIG. 8 shows a side elevation view of the jewelry cage with disc of an embodiment of the disclosed technology.

FIG. 7 shows a front elevation view of the jewelry cage with disc, of an embodiment of the disclosed technology. FIG. 8 shows a side elevation view of the jewelry cage with disc, of an embodiment of the disclosed technology. Discussing these figures simultaneously, the hinge 40 rotates the upper portion 10 away from, and closer to, the lower portion 12 of the cage. When rotated, a ring 32 is attached at 30 hooks around a pin 34 extending outward from the circular region of the lower portion 12 of the cage. Here, it can be seen that the circular region 24 of the disc 20 is partially below and partially above an uppermost horizontal axis or extremity of the lower portion 12 of the cage and will also fit within the portal 14 of the upper portion 10 of the cage.

Figure 5:
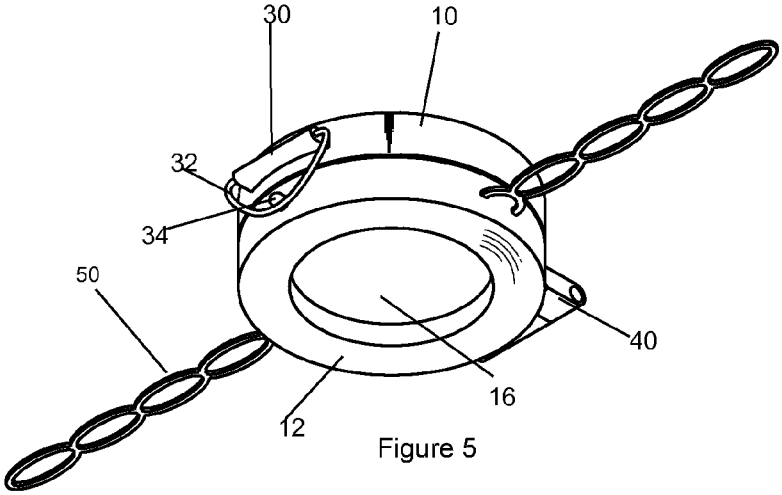
FIG. 5, shows a bottom perspective view of the jewelry cage with disc.
Figure 6:
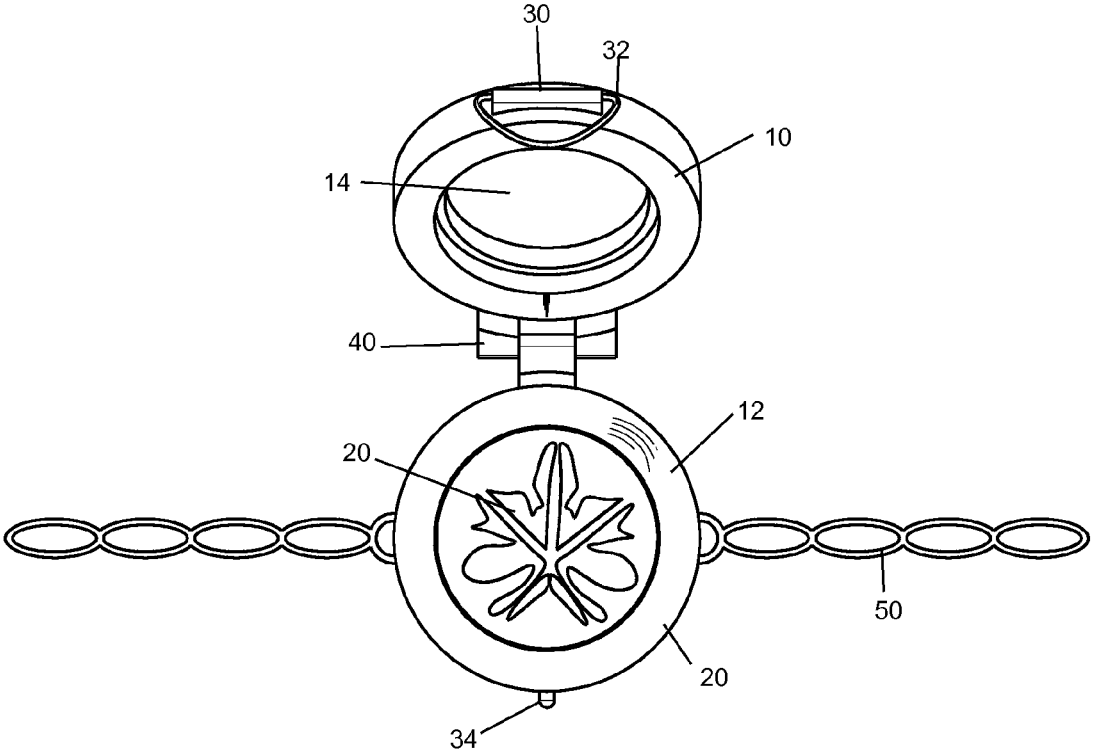
FIG. 6 shows a top plan view of an open jewelry cage with disc of an embodiment of the disclosed technology.

In FIG. 5, a bottom perspective view of the jewelry cage with disc is shown. FIG. 6 shows a top plan view of an open jewelry cage with disc, of an embodiment of the disclosed technology. In FIG. 5, the interior portal 16 into the bottom portion 12 of the cage is visible. In one embodiment, this portal has a solid base, and, in another embodiment, what is seen in FIG. 5 is actually the bottom of the disc 20 viewed through an open portal. Again, the disc 20 fits within the portals (12 and 14) of the upper 10 and lower 12 portions of the jewelry cage. Lips or portions of portals 12 and 14, which circumferentially extend into the portal itself, have a circumference less than that of the widest circumference of disc 20, preventing the disc from passing through either portal 12 or 14.

Figure 1:
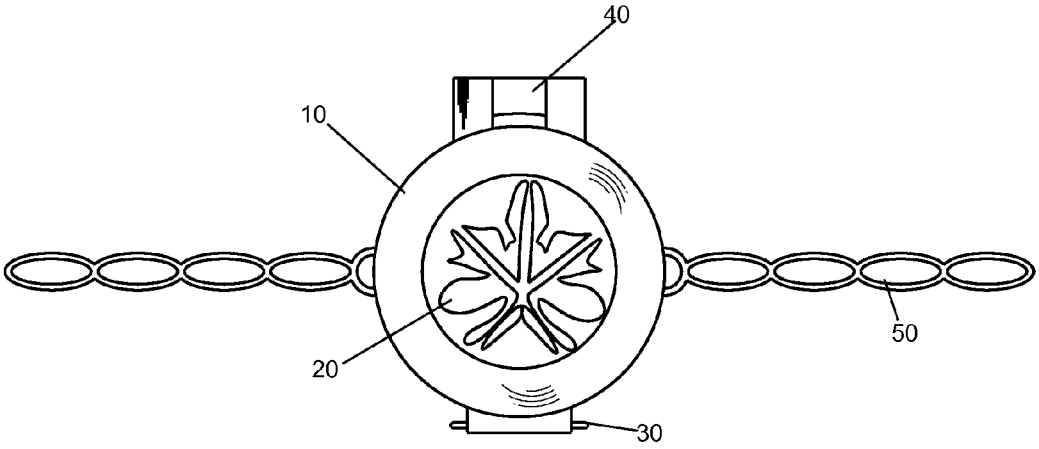
FIG. 1 shows a top view of a closed cage with a disc there-in, in an embodiment of the disclosed technology.
Figure 2:
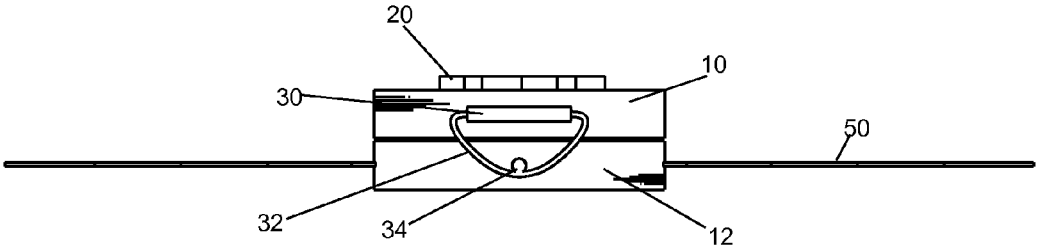
FIG. 2 shows a front elevation view thereof.
Figure 3:
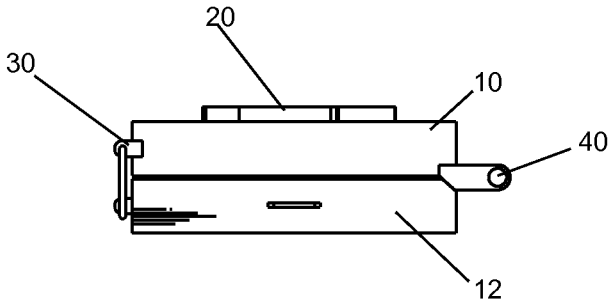
FIG. 3 shows a side elevation view thereof.
Figure 4:
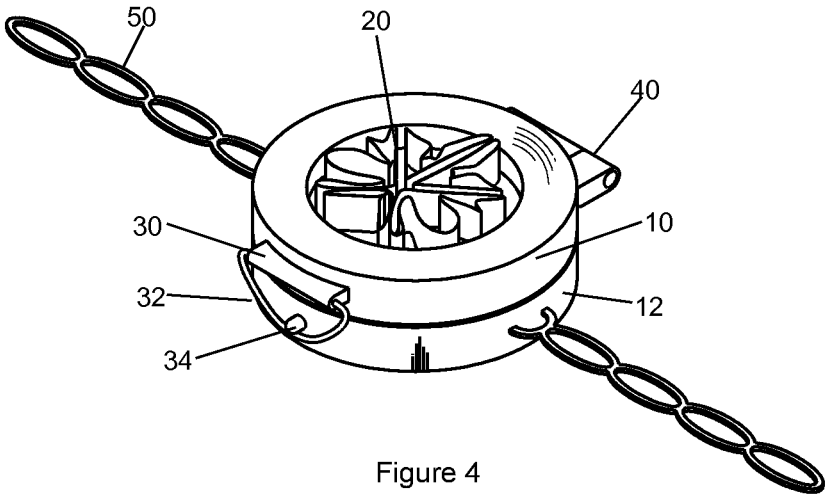
FIG. 4 shows a perspective view thereof.

Finally, referring to FIGS. 1-4, FIG. 1 shows a top view of a closed cage with disc there-in, in an embodiment of the disclosed technology. FIG. 2 shows a front elevation view thereof, FIG. 3 shows a side elevation view thereof, and FIG. 4 shows a perspective view thereof. In this closed configuration, a person can wear the piece of jewelry, such as by extending the chain 50 around the neck or wrist. Then, one may decide to open the cage, remove the disc 20, and place a new disc there-in, such as discs 27, 28, or 29 shown in FIG. 14.

Referring now again to FIGS. 9 and 13, lips/channels within the upper and lower side of the cage are shown. These lip and channel or ridges allow for the snug engagement of the top and bottom halves of the cage as well as the circular disc. More specifically, channel 47 of the upper portion 10 is indented into the edge of the disc between 0.5 mm and 4 mm inclusive, including within an acceptable tolerance level known in the art and specially an amount of 1 mm. This channel engages with corresponding lip 43 of the lower portion 12. Ridge 45 of the upper portion 10 can engage with lip 41 of the lower portion 12.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A jewelry cage, comprising:

an identical circular upper portion and lower portion, said upper portion and said lower portion being separable from one another;

a first part of a closure attached to said circular upper portion and a second part of said closure attached to said circular lower portion, said first and second parts of said closure having an open orientation, in which said upper and lower portions are separated from one another, and a closed orientation, in which said upper and lower portions engage one another;

said circular upper portion having a circular portal, a portion thereof having a first larger circumference, and a portion thereof having a second smaller circumference;

said circular lower portion having a circular portal, a portion thereof having a first larger circumference equal to that of said first larger circumference of said circular portal of said circular upper portion, and a portion thereof having a second smaller circumference equal to that of said second smaller circumference of said circular portal of said circular upper portion;

a hinge pivotally attaching said circular upper portion to said circular lower portion, such that said circular upper portal and said circular lower portal are pivotable about said hinge away from and towards each other, wherein pivoting of said circular upper portion and said circular lower portion about said hinge changes a relative angular orientation between a first circular cross-section of said circular upper portion and a second circular cross section of said circular lower portion, wherein when said circular upper portal and said circular lower portal are pivoted fully towards each other, a continuous portal extending between both said circular upper portal and said circular lower portal is formed, and said circular upper portion and said circular lower portion are aligned at exterior and interior sides of each respective circle of said circular lower portal and said circular upper portal; and a circular disc having a round portion and a raised portion permanently attached, wherein said round portion has a circumference equal to that of said larger circumference of said upper portion, and said larger circumference of said lower portion;

wherein said circumference of said round portion is greater than a circumference of said smaller circumference of said upper portion, and said smaller circumference of said lower portion; and wherein the raised portion has a greatest distance, in a direction parallel to said round portion, less than that of a diameter of said smaller circumference of said upper portion.

2. A cage comprising:

a circular upper portion, a circular lower portion, separable from said circular upper portion, a circular portal having three circular sections including:

a first circular section defined by said circular upper portion, a third circular section defined by said circular lower portion, and a second circular section defined at least by said circular lower portion, and having a diameter greater than that of said first and third circular section;

a disc having a greatest diameter, which is greater than that of said first and third circular sections and less than that of said second circular section;

a hinged upper and lower portion with a connector, said connector having a closed orientation holding said upper and lower portion together and an open orientation wherein said upper and lower portion are separable from one another and wherein in said closed orientation a first cross-section of said upper portion lie parallel to a second cross-section of said lower portion and in said open orientation said first and second cross-sections are angled with respect to one another.

3. The cage of claim 2, wherein said first circular section and said third circular section are identical.

4. The cage of claim 2, wherein said circular disc divides said circular portal into an upper portal portion and a lower portal portion, said upper portal portion having said circular disc at a bottom thereof, and said lower portal portion having said circular disc at a top thereof.

5. The cage of claim 2, wherein said disc has raised indicia, said raised indicia being sufficiently raised so as to extend into said first circular section of said circular upper portion, and said raised indicia form a unitary structure with a circular portion of said disc having said greatest diameter which is greater than that of said first and third circular sections.

6. The cage of claim 5, wherein said raised indicia extend from said circular portion of said disc past said first circular section defined by said circular upper portion.

7. A jewelry cage comprising:

a hinged top and bottom section with a connector, said connector having a closed orientation holding said top and bottom section together and an open orientation wherein said top and bottom section are separable from one another and wherein in said closed orientation a first cross-section of said top section lie parallel to a second cross-section of said bottom section and in said open orientation said first and second cross-sections are angled with respect to one another;

a circular portal extending through said top and said bottom sections, having a greater circumference in a mid-region (where said top and bottom section meet) than at an extremity of each of said top and said bottom sections which are furthest away from the other said bottom and said top section;

a disc with a circumference less than, or equal to, said greater circumference of said mid-region and greater than, or equal to an entirety of said circular portal;

wherein said disc is removably situated in said circular portal and comprises indicia viewable within said circular portal.

8. The jewelry cage of claim 7, wherein said disc is fixed in position with respect to said hinged top and bottom section.

9. The jewelry cage of claim 8, wherein said disc fills an entirety of said mid-region of said circular portal.

10. The jewelry cage of claim 9, wherein said disc fills at least a part of said top section of said circular portal.

11. The jewelry cage of claim 10, wherein said disc extends past said circular portal.

* * * * *